US005739680A

United States Patent [19]

Lim et al.

[11] Patent Number: 5,739,680

[45] Date of Patent: Apr. 14, 1998

[54] CONSTANT VOLTAGE CONTROL DEVICE

[75] Inventors: Chang-Sik Lim, Kyungki-do; Young-Gi Ryou, Seoul, both of Rep. of Korea

[73] Assignee: Samsung Electronics Co., Ltd., Suwon, Rep. of Korea

[21] Appl. No.: 698,021

[22] Filed: Aug. 15, 1996

[30] Foreign Application Priority Data

Aug. 16, 1995 [KR] Rep. of Korea ..... 95-25153

[51] Int. Cl.[6] ..... G05F 3/16

[52] U.S. Cl. ..... 323/313

[58] Field of Search ..... 323/312, 313, 323/284, 211; 363/50; 361/18, 90, 91

[56] References Cited

U.S. PATENT DOCUMENTS

| | | | |
|---|---|---|---|
| 4,975,823 | 12/1990 | Rilly et al. | 363/56 |
| 5,134,355 | 7/1992 | Hastings | 323/211 |
| 5,359,281 | 10/1994 | Barrow et al. | 323/284 |
| 5,513,088 | 4/1996 | Williamson | 363/20 |
| 5,546,300 | 8/1996 | Lee et al. | 363/132 |
| 5,615,093 | 3/1997 | Nalbant | 363/25 |

*Primary Examiner*—Adolf Berhane

*Attorney, Agent, or Firm*—Marger, Johnson, McCollom & Stolowitz, P.C.

[57] ABSTRACT

The present invention relates to a constant voltage control device for preventing parasitic transistors from operating, which comprises a constant voltage generating section, an undervoltage lock-out section, an operation control section, and a supply voltage control section. According to the present invention, parasitic transistors induced during the operation of a switching transistor made of a lateral transistor are prevented from operating by feedback of a signal derived from the Vref signal output from the constant voltage generating section to the operation control section. Unwanted power consumption by the parasitic transistors is reduced and malfunction resulting therefrom is prevented.

11 Claims, 4 Drawing Sheets

CONSTANT VOLTAGE CONTROL DEVICE

BACKGROUND OF THE INVENTION

1. Field of the Invention

The present invention relates to a constant voltage control device which prevents parasitic transistors from operating. More specifically, it is to provide a constant voltage control device which prevents the operation of parasitic transistors induced during the operation of a switching transistor made of a lateral transistor, so that unwanted power consumption by the parasitic transistors can be reduced and malfunctions resulting therefrom can be prevented.

2. Description of the Prior art

In the following description, a constant voltage control device according to a known prior art will be explained by reference to the accompanying drawings, wherein FIG. 1 is a block diagram showing a prior art constant voltage control device;

FIG. 2 is a cross sectional view of a lateral transistor; and

FIG. 3 is a circuit diagram showing the operation of parasitic transistors.

As shown in FIG. 1, the constant voltage control device according to the prior art comprises a constant voltage generating section 30, which produces a reference voltage Vref of constant magnitude. An undervoltage lock-out section 20 (UVLO) operates hysteretically in response to input of a supply voltage Vss to produce a signal for controlling the operation of the constant voltage generating section 30. An operation control section 10 determines whether or not to pass the supply voltage Vss to the undervoltage lock-out section 20, according to an operation control signal STT input thereto.

The operation control section 10 comprises a first bipolar transistor Q11 which has an emitter connected to a voltage source Vet, and a collector through which the supply voltage Vss is passed over; and a second bipolar transistor Q12 of which the base is fed with the operation control signal STT, the emitter is grounded, and the collector is connected to the base of said first transistor Q11.

The above prior art constant voltage control device operates as follows:

Assuming that the voltage source Vcc has been applied to the first transistor Q11 of the operation control section 10, if the operation control signal STT of high level is fed to the base of the second transistor Q12, the second transistor Q12 is turned on and subsequently the first transistor Q11 is turned on as well.

Accordingly, through the collector of the first transistor Q11 of the operation control section 10, the supply voltage Vss is passed over to the undervoltage lock-out section 20.

If the supply voltage Vss is above a certain reference level, the undervoltage lock-out section 20 forces the constant voltage generating section 30 to produce a reference voltage Vref. Otherwise, UVLO section stops the operation of the constant voltage generating section 30 so that the output Vref of the constant voltage generating section 30 can not fall below a certain constant level.

In the above circuit, the first transistor Q11, which is in saturation region, passes over the supply voltage Vss to the undervoltage lock-out 20. The first transistor Q11 consists of a lateral transistor as shown in FIG. 2. The lateral transistor has a structure in which the emitter, base, and collector are arranged sideways on the surface of a semiconductor wafer. The base B is formed out of an n epitaxial layer on a p substrate. The emitter E and collector C are formed through p diffusions as shown in FIG. 2.

However, as shown in FIG. 3, besides an intended transistor Q, the lateral transistor is accompanied by parasitic transistors $Q_A$ and $Q_b$, operating on the sides of the emitter and collector, respectively, of the transistor Q.

The constant voltage control device according to the prior art thus can lead to unwanted power consumption by the parasitic transistors induced when the switching transistor Q11 of the operation control section 10 passes over the supply voltage Vss in its saturation region, and can lead to a malfunction of the entire system.

SUMMARY OF THE INVENTION

It is therefore an object of the present invention to solve the above problem by providing a constant voltage control device which prevents the operation of parasitic transistors induced during the operation of a switching transistor made of a lateral transistor, reduces unwanted power consumption by the parasitic transistors, and prevents malfunctions resulting therefrom.

The present invention comprises:

constant voltage generating means for producing a reference voltage of constant magnitude;

undervoltage lock-out means for operating hysteretically in response to an input supply voltage to produce a signal for controlling the operation of said constant voltage generating means;

operation control means for operating in accordance with an operation control signal input thereto to determine whether to pass over the supply voltage to said undervoltage lock-out means; and supply voltage control means for feeding back the reference voltage outputted from said constant voltage generating means to control the output of said operation control means.

Another aspect of the invention is a method of controlling a constant voltage control device having an operating control section which includes a switching transistor made of a lateral transistor as above-described by preventing the parasitic transistors of the lateral transistor from operating.

The foregoing and additional objects, features and advantages of the invention will become more readily apparent from the following detailed description of a preferred embodiment, which proceeds with reference to the accompanying drawings.

DETAILED DESCRIPTION OF THE PREFERRED EMBODIMENT

Figure 1:
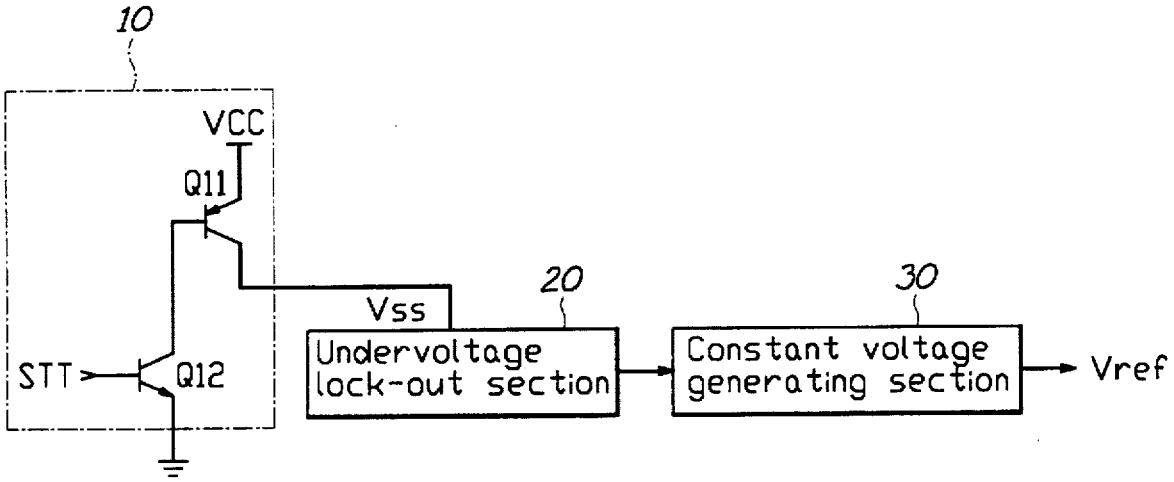
FIG.1 (Prior Art)
FIG. 1 is a block diagram showing a prior art constant voltage control device.
Figure 2:
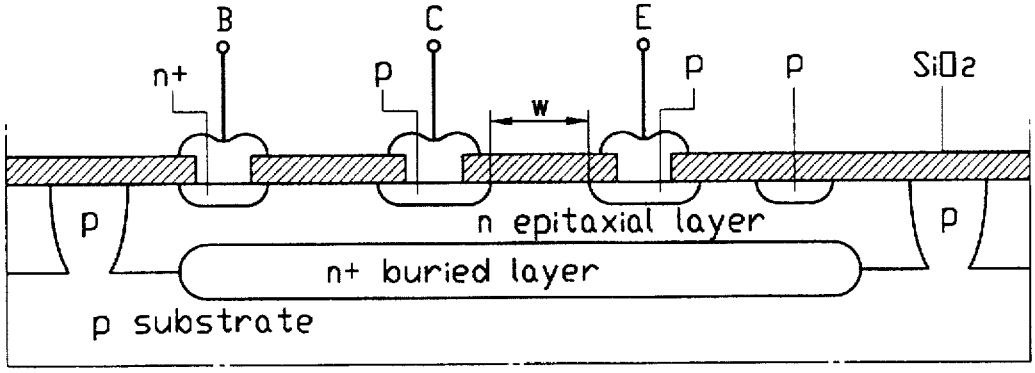
FIG.2 (Prior Art)
FIG. 2 is a cross sectional view of a lateral transistor of a type conventionally used in a constant voltage control device.
Figure 3:
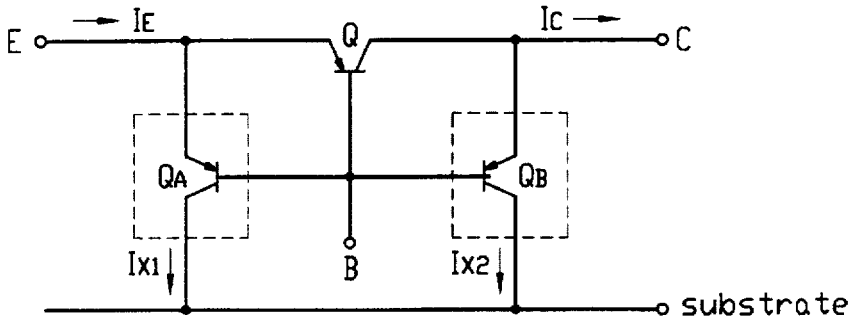
FIG.3 (Prior Art)
FIG. 3 is a circuit diagram showing the operation of parasitic transistors in the device of FIG. 2.
Figure 4:
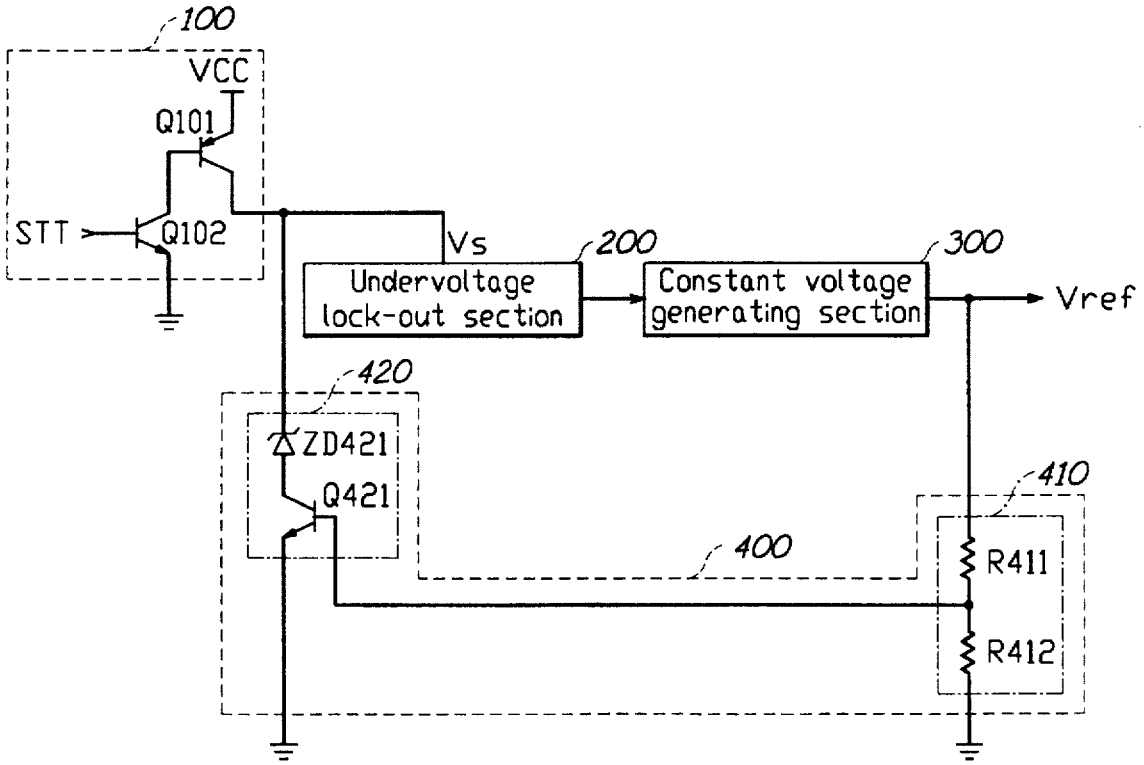
FIG. 4 is a block circuit diagram showing a constant voltage control device for preventing parasitic transistors from operating according to an embodiment of the present invention.

As shown in FIG. 4, the constant voltage control device for preventing parasitic transistors from operating comprises:

- a constant voltage generating section 300 which produces a reference voltage of constant magnitude;
- an undervoltage lock-out section 200 which operates hysteretically in response to an inputted supply voltage to produce a signal for controlling the operation of said constant voltage generating section 300;
- an operation control section 100 which operates in accordance with an inputted operation control signal to determine whether to pass over the supply voltage to said undervoltage lock-out section 200; and
- a supply voltage control section 400 which feeds back the reference voltage outputted from said constant voltage generating section 300 to control the output of said operation control section 100.

Operation control section 100 comprises a first bipolar transistor Q101 which has an emitter connected to a voltage source VCC, and a collector through which the supply voltage Vs is passed over to UVLO section 200, and a second bipolar transistor Q102 of which the base is fed with the operation control signal STT, the emitter is grounded, and the collector is connected to the base of said first transistor Q101.

Figure 5:
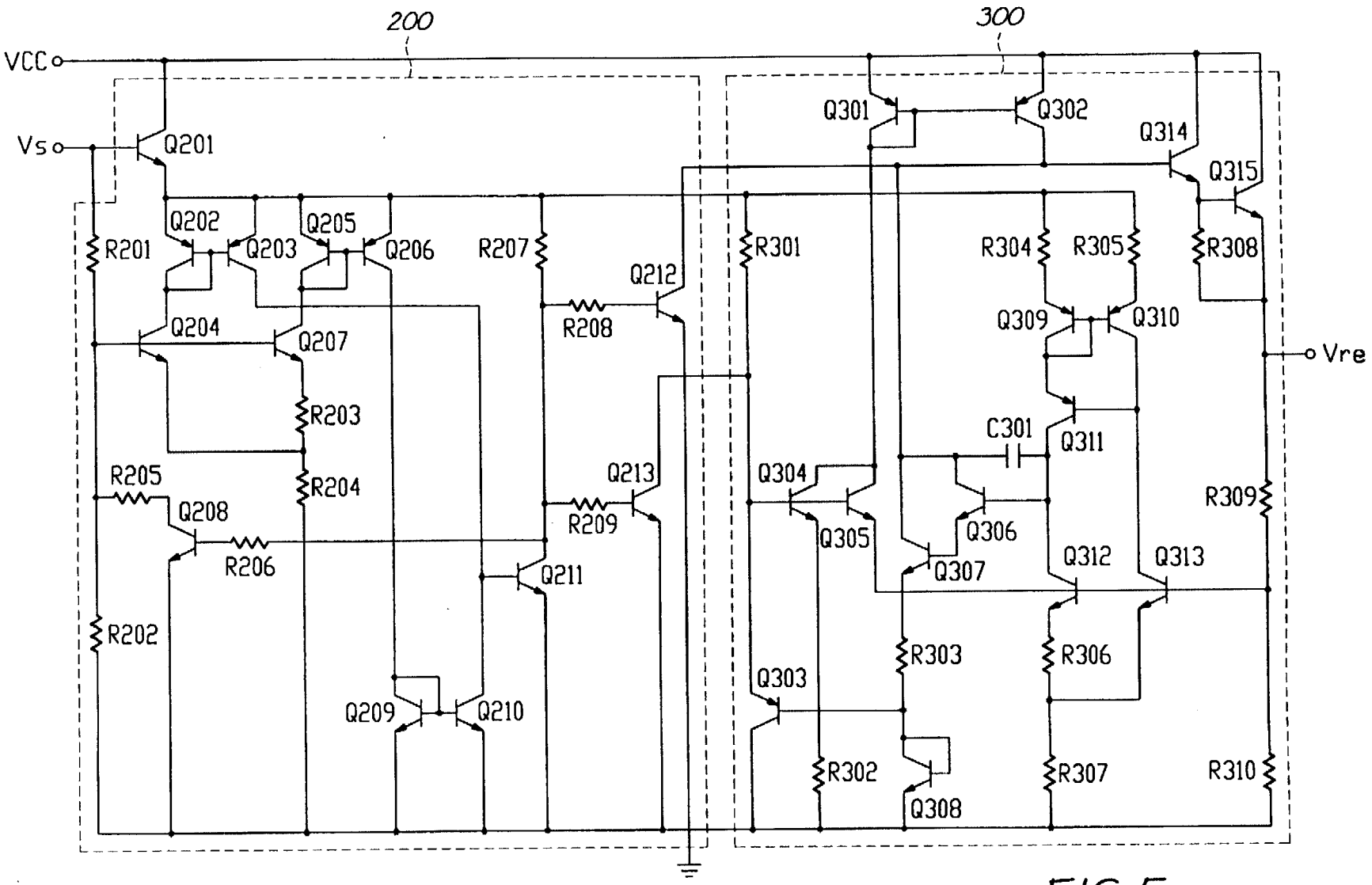
FIG. 5 is a detailed circuit diagram of the undervoltage lock-out section and constant voltage generating section in FIG. 4.

Referring to FIG. 5, undervoltage lock-out section 200 comprises a first transistor Q201 of which the collector is connected to the voltage source VCC, and the base is fed with the supply voltage Vs. A first resistor R201 is coupled at one end to the supply voltage Vs and at the opposite end to a second resistor R202 of which one end is grounded. A second transistor Q202 has an emitter connected to the emitter of said first transistor Q201, and its base and collector are coupled together. A third transistor Q203 has an emitter connected to the emitter of said first transistor Q201, and a base is connected to the base of said second transistor Q202. A fourth transistor Q204 has a collector is connected to the collector of said second transistor Q202, and a base connected to the opposite end of said first resistor R201, that is, the node between resistors R201 and R202. A fifth transistor Q205 has an emitter connected to the emitter of said first transistor Q201, and its base and collector are coupled together. A sixth transistor Q206 has an emitter connected to the emitter of said first transistor Q201, and a base is connected to the base of said fifth transistor Q205. A seventh transistor Q207 has a collector is connected to the collector of said fifth transistor Q205, and a base connected to the opposite end of said first resistor R201. A third resistor R203 has one end connected to the emitter of said seventh transistor Q207, and the opposite end connected to the emitter of said fourth transistor Q204. A fourth resistor R204 has one end grounded and the other end connected to the opposite end of said third resistor R203. A fifth resistor R205 has one end connected to the opposite end of said first resistor R201. An eighth transistor Q208 has a collector connected to the other end of said fifth resistor R205, and the emitter is grounded. A sixth resistor R206 has one end is connected to the base of said eighth transistor Q208. A seventh resistor R207 has one end connected to the emitter of said first transistor Q201, and an opposite end connected to the other end of said sixth resistor R206. A ninth transistor Q209 has a collector and base connected to the collector of said sixth transistor Q206, and the emitter is grounded. A tenth transistor Q210 has a collector connected to the collector of said third transistor Q203, a base connected to the base of said ninth transistor Q209, and a grounded emitter. An eleventh transistor Q211 has a base connected to the collector of said third transistor Q203, a collector connected to the other end of said seventh resistor R207, and grounded emitter. An eighth resistor R208 has one end connected to the other end of said seventh resistor R207. A twelfth transistor Q212 has base connected to the other end of said eighth resistor R208, and a grounded emitter. A ninth resistor R209 has one end connected to the other end of said seventh resistor R207. A thirteenth transistor Q213 has a base connected to the other end of said ninth resistor R209, and a grounded emitter.

Said constant voltage generating section 300 comprises a first transistor Q301 of which the emitter is connected to the voltage source VCC, and the base and collector are coupled together. A second transistor Q302 has an emitter connected to the voltage source VCC, a base connected to the base of said first transistor Q301, and a collector connected to the collector of the twelfth transistor Q212 of said undervoltage lock-out section 200. A first resistor R301 has one end connected to the emitter of the first transistor Q201 of said undervoltage lock-out section 200, and the other end is connected to the thirteenth transistor Q213 of said undervoltage lock-out section 200. A third transistor Q303 has an emitter connected to the other end of said first resistor R301, and a grounded collector. A fourth transistor Q304 has a base connected to the other end of said first resistor R301, and a collector connected to the collector of said first transistor Q301. A second resistor R302 has one end is connected to the emitter of said fourth transistor Q304, and the other end is grounded. A fifth transistor Q305 has a collector connected to the collector of said first transistor Q301, and a base connected to the other end of said first resistor R301. A sixth transistor Q306 has a collector connected to the collector of the twelfth transistor Q212 of said undervoltage lock-out section 200. A capacitor C301 has one end connected to the collector of the twelfth transistor Q212 of said undervoltage lock-out section 200, and the other end is connected to the base of said sixth transistor Q306. A seventh transistor Q307 has a collector connected to the collector of the twelfth transistor Q212 of said undervoltage lock-out section 200, and a base connected to the emitter of said sixth transistor Q306. A third resistor R303 is connected at one end to the emitter of said seventh transistor Q307, and is connected at the other end to the base of said third transistor Q303. An eighth transistor Q308 has a base and collector connected to the base of said third transistor Q303, and a grounded emitter. A fourth resistor R304 has one end connected to the emitter of the first transistor Q201 of said undervoltage lock-out section 200. A ninth transistor has an emitter connected to the other end of said fourth resistor R304, and a base and collector coupled together. A fifth resistor R305 has one end connected to the emitter of the first transistor Q201 of said undervoltage lock-out section 200. A tenth transistor Q310 has emitter connected to the other end of said fifth resistor R305, and a base is connected to the base of said ninth transistor Q309. An eleventh transistor Q311 has an emitter is connected to the collector of said ninth transistor Q309, a base connected to the collector of said tenth transistor Q310, and a collector connected to the base of said sixth transistor Q306. A twelfth transistor Q312 has a collector connected to the collector of said eleventh transistor Q311, and a base connected to the emitter of said fifth transistor Q305. A thirteenth transistor Q313 has a collector connected to the collector of said tenth transistor Q310, and a base connected to the emitter of said fifth transistor Q305. A sixth resistor R306 has one end connected to the emitter of said twelfth transistor Q312, and the other end is connected to the emitter of said thirteenth transistor Q313. A seventh resistor R307 has one end connected to the other end of said sixth resistor R306, and the other end is grounded. A fourteenth transistor Q314 has a collector connected to the voltage source VCC, and a base connected to the collector of the twelfth transistor Q212 of said undervoltage lock-out section 200. A fifteenth transistor Q315 has a collector connected to the voltage source VCC, and a base connected to the emitter of said fourteenth transistor Q314. An eighth resistor R308 has one end connected to the emitter of said fourteenth transistor Q314, and the other end is connected to the emitter of said fifteenth transistor Q315. A ninth resistor R309 has one end connected to the emitter of said fifteenth transistor Q315, and the other end connected to the base of said thirteenth transistor Q313. A tenth resistor R310 has one end grounded, and the other end connected to the other end of said ninth resistor R309.

Referring back to FIG. 4, supply voltage control section 400 comprises:

- a feedback section 410 which converts the reference voltage Vref output from said constant voltage generating section 300 into a constant signal to feed back the signal; and
- a supply voltage keeping section 420 which operates in accordance with the signal output from said feedback section 410 to keep the supply voltage Vs output from said operation control section 100 at a constant level.

Feedback section 410 comprises a first resistor R411 with one end connected to the output terminal of said constant voltage generating section 300 and fed with the reference voltage Vref; and a second resistor R412 with one end grounded and the other end connected to the other end of said first resistor R411, defining a feedback signal node.

Supply voltage keeping section 420 comprises a transistor Q421 having a base connected to the other end of the first resistor R411 of said feedback section 410, that is, at the feedback signal node; and a diode ZD421 of which the anode is connected to the collector of said transistor Q421, and the cathode is connected to the collector of the first transistor Q101 of said operation control section 100.

The device according to an embodiment of the present invention, which comprises the above components, operates as follows:

Assuming that the voltage source VCC has been applied to the first transistor Q101 of the operation control section 100, if the operation control signal STT of high level is fed to the base of the second transistor Q102, said second transistor Q102 is turned on and subsequently the first transistor Q101 is turned on as well.

Accordingly, through the collector of said first transistor Q101, the supply voltage Vs is passed over to the undervoltage lock-out section 200.

In order to get the supply voltage Vs closer to the voltage source VCC, said first transistor Q101 which has been turned on operates in its saturation region.

If the supply voltage Vs which has been passed over to the undervoltage lock-out section 200 is above a certain reference level, said undervoltage lock-out section 200 forces the constant voltage generating section 300 to produce a reference voltage Vref. Otherwise, it stops the operation of the constant voltage generating section 300 so that the output Vref of the constant voltage generating section 300 cannot fall below a certain constant level.

The first transistor Q101 of said operation control section 100, while it operates in its saturation region, would induce parasitic transistors to operate. In accordance with the invention, however, the supply voltage control section 400 feeds back a feedback signal derived from the reference voltage Vref output from the constant voltage generating section 300 so as to prevent said first transistor Q101 from operating in its saturation region.

In detail, the feedback section 410 converts the reference voltage Vref into a constant signal divided through the first and second resistor R411, R412 to feed back the signal. Then, the supply voltage keeping section 420 turns on the transistor Q421 in accordance with the feedback signal output from said feedback section 410 to keep the level of the supply voltage Vs at a constant voltage Vz, so that the first transistor Q101 of the operation control section 100 is prevented from operating in its saturation region.

Accordingly, parasitic transistors are not induced to operate, and the reference voltage Vref outputted from the constant voltage generating section 300 maintains a constant level.

Figure 6:
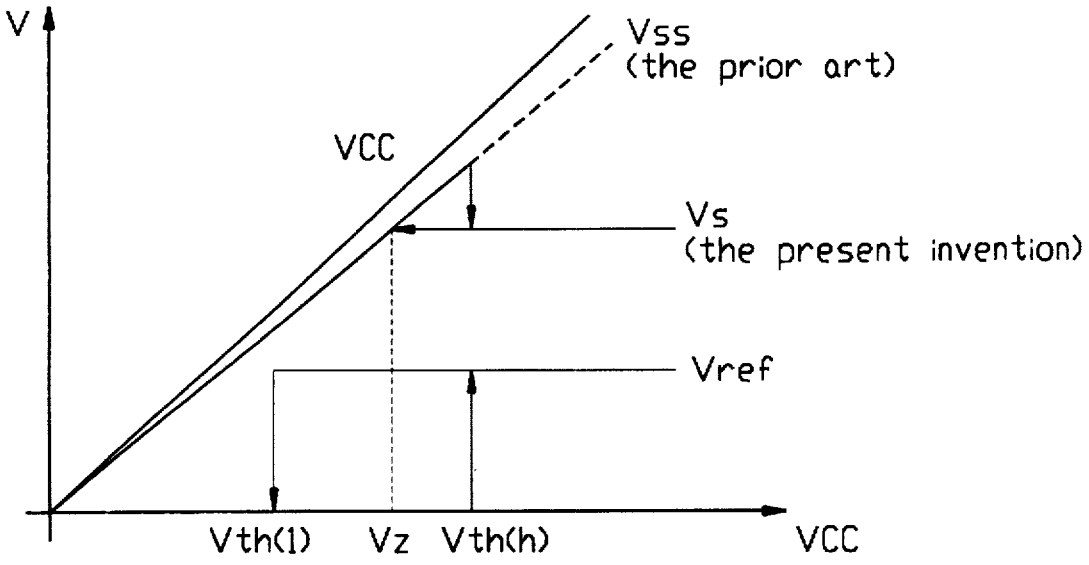
FIG. 6 is a graph of voltage characteristic curves comparing the operation of the circuits in FIG. 1 and FIG. 4;.

As shown in FIG. 6, in the constant voltage control device according to prior art, as the voltage source VCC increases, the supply voltage Vss continues to increase in close correspondence to the voltage source VCC. In the constant voltage control device according to an embodiment of this invention, however, the supply voltage Vs increases only up to a constant level Vz, which is between an upward threshold Vth(h) and a downward threshold Vth(1), and then keeps this level, not increasing any more.

Figure 7:
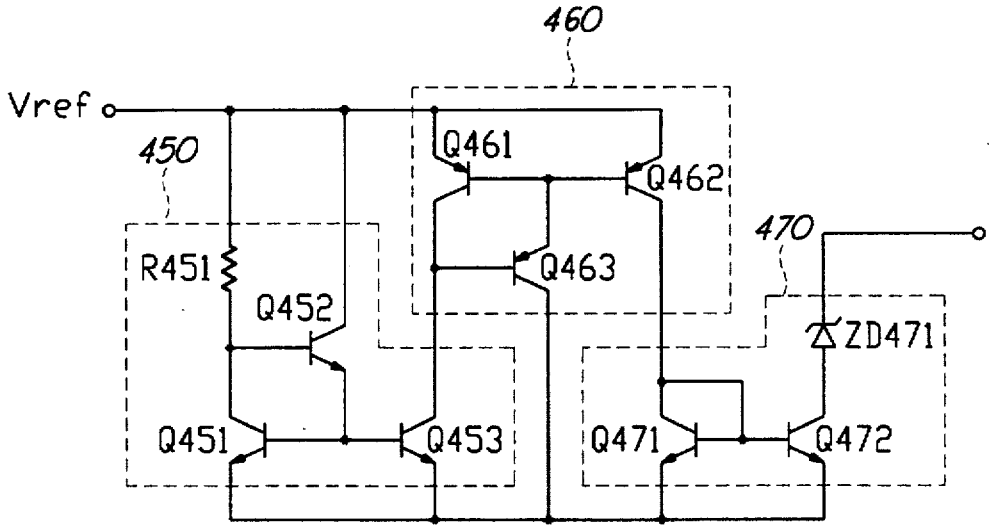
FIG. 7 is a circuit diagram according to another embodiment of the supply voltage control section in FIG. 4.

FIG. 7 is a circuit diagram of another embodiment of the supply voltage control section 400 in FIG. 4. As shown in FIG. 7, the supply voltage control section comprises:

- a feedback section 450 which converts the reference voltage Vref output from said control voltage generating section 300;
- a stabilizing section 460 which stabilizes the signal outputted from said feedback section 450; and
- a supply voltage keeping section 470 which operates in accordance with a signal output from said stabilizing section 460 to keep the supply voltage Vss output from said operation control section 100 at a constant level.

The feedback section 450 comprises a resistor R451 having one end connected to the output terminal of said constant voltage generating section 300 and fed with the reference voltage Vref. A first transistor Q451 has a collector connected to the other end of resistor R451 and a grounded emitter. A second transistor Q452 has aa base connected to the other end of said resistor R451 and an emitter connected to the base of said first transistor Q451. A third transistor Q453 has a base connected to the base of said first transistor Q451 and a grounded emitter.

Stabilizing section 460 comprises a first transistor Q461 has an emitter which is fed with the reference voltage Vref, and a collector connected to the collector of the third transistor Q453 of said feedback section 450. A second transistor Q462 has an emitter which is fed with the reference voltage Vref, and a base connected to the base of said first transistor Q461. A third transistor Q463 has an emitter connected to the base of said first transistor Q461, a base is connected to the collector of said first transistor Q461, and a grounded collector.

Supply voltage keeping section 470 comprises a first transistor Q471 of which the collector and base are connected to the collector of the second transistor Q462 of said stabilizing section 460, and the emitter is grounded. A second transistor Q472 has base connected to the base of said first transistor Q471 and the emitter is grounded. A diode ZD471 has an anode connected to the collector of said second transistor Q472, and a cathode connected to the collector of the first transistor Q101 of operation control section 100.

The above supply voltage control section according to the FIG. 7 embodiment of the present invention operates as follows:

The supply voltage control section 400 feeds back the reference voltage Vref outputted from said constant voltage generating section 300 to prevent the first transistor Q101 of said operation control section 100 from operating in its saturation region, so that parasitic transistors are not induced to operate.

In detail, the feedback section 450 converts the reference voltage Vref into a constant signal to feed back the signal. The stabilizing section 460 stabilizes the signal outputted from the feedback section 450. The supply voltage keeping section 470 operates in accordance with a signal output from the stabilizing section 460 to keep the supply voltage Vs at a constant level Vz, so that the first transistor Q101 of said operation control section 100 is prevented from operating in its saturation region.

Consequently, an advantage achieved with the present invention is that a constant voltage control device for preventing parasitic transistors from operating is provided, in which parasitic transistors induced during the operation of a switching transistor made of a lateral transistor are prevented from operating so that unwanted power consumption by the parasitic transistors is reduced and malfunction resulting therefrom is prevented.

Having illustrated and described the invention in a preferred and alternative embodiments it should be apparent that the invention can be modified in arrangement and detail without departing from its principles. We claim all variations and modifications coming within the scope and spirit of the following claims.

What is claimed is:

1. A constant voltage control device, comprising:

constant voltage generating means for producing a reference voltage of constant magnitude;

undervoltage lock-out means for operating hysteretically in response to an input supply voltage to produce a signal for controlling the operation of said constant voltage generating means;

operation control means for operating in accordance with an operation control signal input thereto to determine whether to pass over the supply voltage to said undervoltage lock-out means; and supply voltage control means for feeding back the reference voltage output from said constant voltage generating means to control the output of said operation control means said supply voltage control means comprising:

feedback means for converting the reference voltage output from said control voltage generating means into a constant signal to feed back the signal, said feedback means comprising:

a first resistor having one end connected to the output terminal of said constant voltage generating means and fed with the reference voltage; and a second resistor having one end grounded, and another end connected to a second end of said first resistor to define a feedback node; and supply voltage keeping means for operating in accordance with a signal output from said feedback means to keep the supply voltage output from said operation control means at a constant level.

2. A device as stated in claim 1, wherein said operation control means comprises:

a first transistor which has an emitter connected to a voltage source, and the collector through which the supply voltage is passed over; and a second transistor having a base which is fed with the operation control signal, a grounded emitter, and a collector connected to the base of said first transistor.

3. A device as stated in claim 1, in which said supply voltage keeping means comprises:

a transistor having a base connected to the second end of the first resistor of said feedback means; and a diode having an anode connected to the collector of said transistor, and a cathode connected to a collector of the first transistor of said operation control means.

4. A device as stated in claim 1, in which said supply voltage control means comprises stabilizing means for stabilizing the signal output from said feedback means.

5. A constant voltage control device, comprising:

constant voltage generating means for producing a reference voltage of constant magnitude;

undervoltage lock-out means for operating hysteretically in response to an input supply voltage to produce a signal for controlling the operation of said constant voltage generating means;

operation control means for operating in accordance with an operation control signal input thereto to determine whether to pass over the supply voltage to said undervoltage lock-out means;

supply voltage control means for feeding back the reference voltage output from said constant voltage generating means to control the output of said operation control means, said supply voltage control means including:

feedback means for converting the reference voltage output from said control voltage generating means into a constant signal to feed back he signal, said feedback means comprising:

a resistor having one end connected to the output terminal of said constant voltage generating means and fed with the reference voltage;

a first transistor having a collector connected to the other end of said resistor, and a grounded emitter;

a second transistor having a base connected to a second end of said resistor, and an emitter connected to a base of said first transistor; and a third transistor having a base connected to a base of said first transistor, and a grounded emitter; and stabilizing means for stabilizing the signal output from said feedback means; and supply voltage keeping means for operating in accordance with a signal output from said stabilizing means to keep the supply voltage output from said operation control means at a constant level.

6. A device as stated in claim 5, in which said stabilizing means comprises:

a first transistor having an emitter which is fed with the reference voltage, and a collector connected to a collector of the third transistor of said feedback means;

a second transistor having an emitter which is fed with the reference voltage, and a base connected to a base of said first transistor; and a third transistor having an emitter connected to the base of said first transistor, a base connected to the collector of said first transistor, and a grounded collector.

7. A device as stated in claim 6, in which said supply voltage keeping means comprises:

a first transistor having a collector and base connected to a collector of the second transistor of said stabilizing means, and a grounded emitter;

a second transistor having abase connected to the base of said first transistor, and a grounded emitter; and a diode having an anode connected to a collector of said second transistor, and a cathode connected to a collector of a first transistor of said operation control means.

8. A constant voltage control device, comprising:

constant voltage generating means for producing a reference voltage of constant magnitude;

undervoltage lock-out means for operating hysteretically in response to an input supply voltage to produce a signal for controlling the operation of said constant voltage generating means;

operation control means for operating in accordance with an operation control signal input thereto to determine whether to pass over the supply voltage to said undervoltage lock-out means; and a supply voltage control circuit coupled to feed back the reference voltage output from said constant voltage generating means to control the output of said operation control means, said supply voltage control circuit including:

a first resistor having one end connected to the output terminal of said constant voltage generating means and fed with the reference voltage; and a second resistor having one end grounded, and another end connected to a second end of said first resistor to define a feedback node.

9. A device as stated in claim 8, wherein said operation control means comprises:

a first transistor which has an emitter connected to a voltage source, and the collector through which the supply voltage is passed over; and a second transistor having a base which is fed with the operation control signal, a grounded emitter, and a collector connected to the base of said first transistor.

10. A constant voltage control device, comprising:

constant voltage generating means for producing a reference voltage of constant magnitude;

undervoltage lock-out means for operating hysteretically in response to an input supply voltage to produce a signal for controlling the operation of said constant voltage generating means;

operation control means for operating in accordance with an operation control signal input thereto to determine whether to pass over the supply voltage to said undervoltage lock-out means;

a supply voltage control circuit coupled to feed back the reference voltage output from said constant voltage generating means to control the output of said operation control means, said supply voltage control circuit including:

a resistor having one end connected to the output terminal of said constant voltage generating means and fed with the reference voltage;

a first transistor having a collector connected to the other end of said resistor, and a grounded emitter;

a second transistor having a base connected to a second end of said resistor, and an emitter connected to a base of said first transistor; and a third transistor having a base connected to a base of said first transistor, and a grounded emitter.

11. A device as stated in claim 10 in which the supply voltage control circuit further includes:

a first transistor having an emitter which is fed with the reference voltage, and a collector connected to a collector of the third transistor of said feedback means;

a second transistor having an emitter which is fed with the reference voltage, and a base connected to a base of said first transistor; and a third transistor having an emitter connected to the base of said first transistor, a base connected to the collector of said first transistor, and a grounded collector.

* * * * *